US005718332A

United States Patent [19]

Tachibana

[11] Patent Number: 5,718,332

[45] Date of Patent: Feb. 17, 1998

[54] LOCK CONTAINER FOR CONTAINING COMPACT DISKS AND THE LIKE

[75] Inventor: Masuo Tachibana, Tokyo, Japan

[73] Assignee: Hagoromo, Inc., Tokyo, Japan

[21] Appl. No.: 775,867

[22] Filed: Jan. 2, 1997

[30] Foreign Application Priority Data

Jun. 6, 1996 [JP] Japan ..... 8-144006

[51] Int. Cl.[6] ..... B65D 85/57

[52] U.S. Cl. ..... 206/308.2; 206/1.5; 206/387.11; 206/807

[58] Field of Search ..... 206/308.1, 308.2, 206/309, 387.11, 1.5, 807, 818

[56] References Cited

U.S. PATENT DOCUMENTS

| | | | |
|---|---|---|---|
| 4,760,914 | 8/1988 | Gelardi et al. | 206/308.2 |
| 5,215,189 | 6/1993 | Weisburn et al. | 206/1.5 |
| 5,524,752 | 6/1996 | Mazzucchelli | 206/308.2 |
| 5,588,315 | 12/1996 | Holmgren | 206/1.5 |

FOREIGN PATENT DOCUMENTS

| | | | |
|---|---|---|---|
| 508201 | 10/1992 | European Pat. Off. | 206/308.2 |

*Primary Examiner*—Paul T. Sewell

*Assistant Examiner*—Luan K. Bui

*Attorney, Agent, or Firm*—Nikaido Marmelstein Murray & Oram LLP

[57] ABSTRACT

Disclosed is a lock container for compact disks and the like comprising a casing having an opening to permit a compact disk to get in or out on its rear side, and a push button-like locking means provided to the top side of the casing to prevent the compact disk from getting out of the rear opening in locking condition. The push button-like locking means comprises a lateral spring strip and an associated movable push piece. The lateral spring strip is responsive to depression of the push piece for catching the step-like projection of the push piece, thereby fastening the compact disk with the latch, and is responsive to application of magnetic force for releasing the step-like projection of the push piece from the lateral spring strip. Thus, the lock container can be locked simply by depressing the push piece, and can be unlocked simply by applying a magnet to the casing.

5 Claims, 2 Drawing Sheets

LOCK CONTAINER FOR CONTAINING COMPACT DISKS AND THE LIKE

BACKGROUND OF THE INVENTION

1. Field of the Invention

The present invention relates to a lock container for containing and fastening a compact disk with a latch, an anti-crime tag being contained therein, also.

2. Description of Related Art

Compact disks or videotapes have magnetically or electrically responsive anti-crime tags attached thereto, thereby preventing these articles from being stolen from shops. Such tags, however, are often removed or cut away from the articles. In an attempt to prevent removal of anti-crime tags lock containers are used to contain and fasten anti-tagged compact disks with a latch. When the compact disk is sold, the lock container is unlocked to take out and pass the compact disk to a customer.

Such a lock container uses a cylinder lock or tumbler lock, and it is unlocked by using a key. The key is used so many times every day that it may be deformed, worn or broken within a short time. Also, disadvantageously the unlocking with the aid of key is not convenient. Still disadvantageously the key can be easily copied for criminal purpose.

SUMMARY OF THE INVENTION

In view of the above one object of the present invention is to provide a lock container for containing compact disks, which container can be unlocked with a magnet, which is free of deformation or breakage no matter how many times it may be used.

To attain this and other objects a lock container for containing compact disks and the like comprising a casing having an opening to permit a compact disk to get in or out, and a push button-like locking means provided to one side of the casing to prevent the compact disk from getting out of the opening.

The casing may have catch pieces integrally connected to selected areas of the upper and lower sides such as the corners of the casing.

The push button-like locking means may comprise a lateral spring strip, a push piece partly projecting from said one side of the casing in unlatching position, said push piece having step-like projection to be caught by the lateral spring strip when depressed to be put in latching position in which the compact disk is locked within the casing, and a spring fixed to the push piece to cause the push piece to return to the unlatching position in response to application of magnetic attraction to said lateral spring strip, thereby releasing the push piece from the spring strip.

Other objects and advantages of the present invention will be understood from the following description of a lock container according to a preferred embodiment of the present invention, which is shown in accompanying drawings.

DESCRIPTION OF THE PREFERRED EMBODIMENTS

Figure 1:
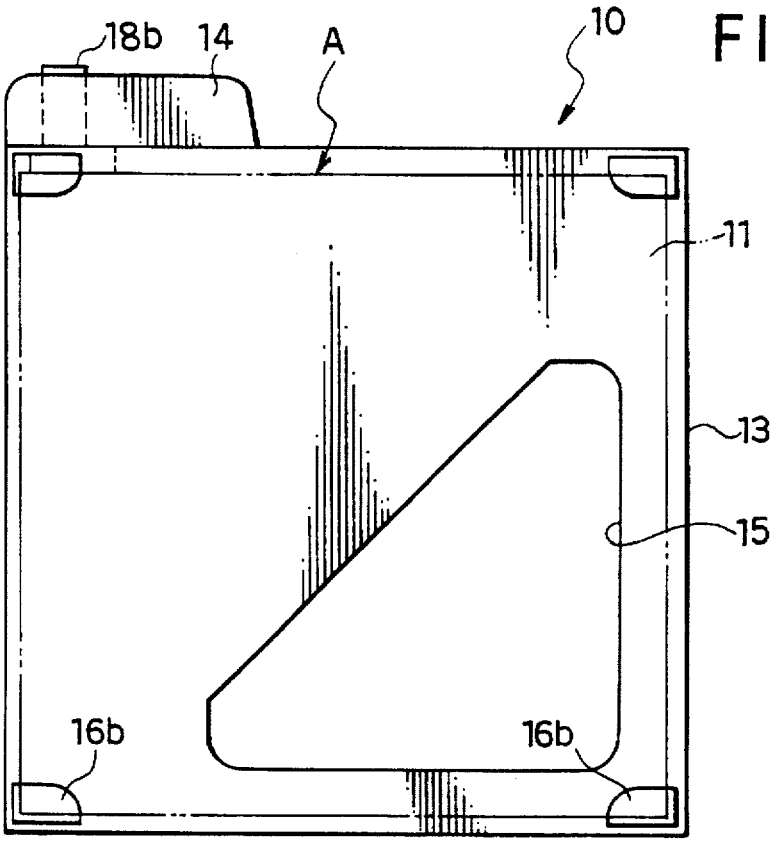
FIG. 1 is a front view of a lock container for containing compact disks and the like according to a preferred embodiment of the present invention.
Figure 2:
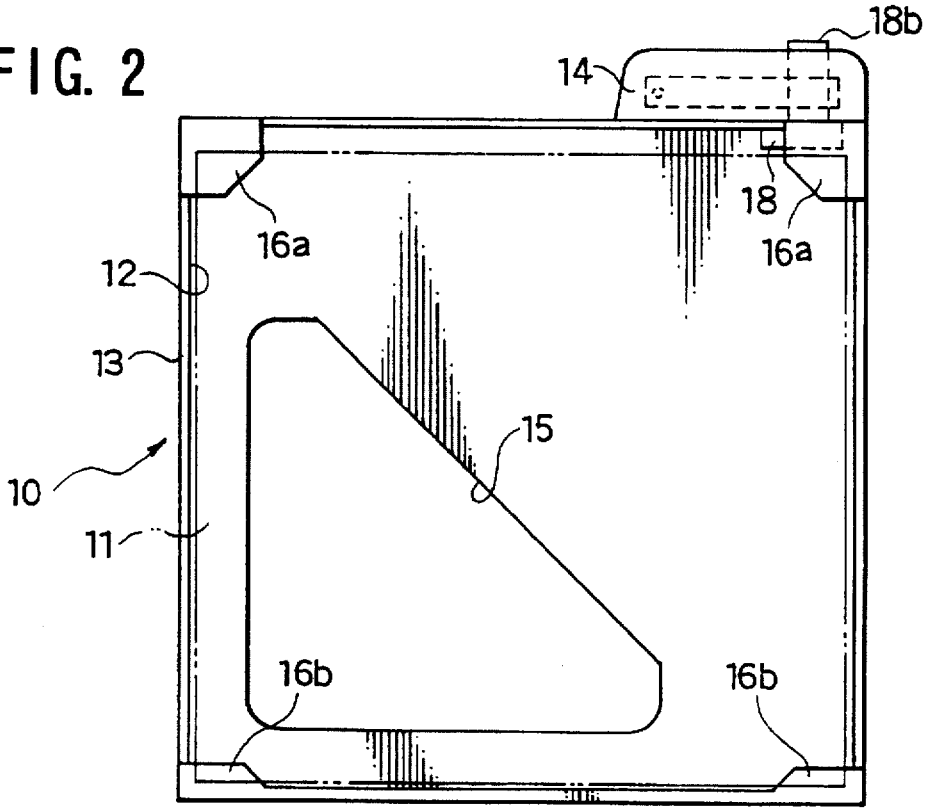
FIG. 2 is a rear view of the lock container.
Figure 3:
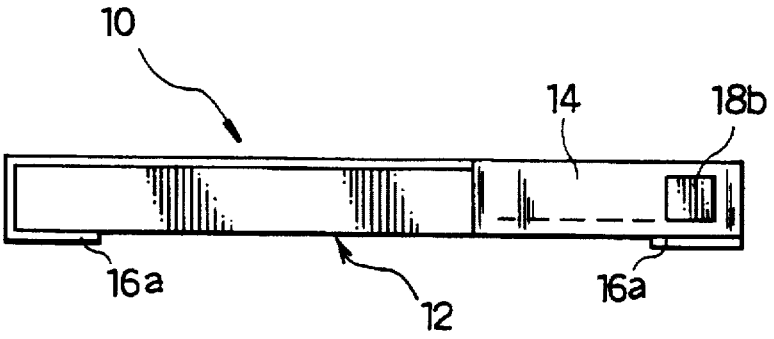
FIG. 3 is an top end view of the lock container.
Figure 4:
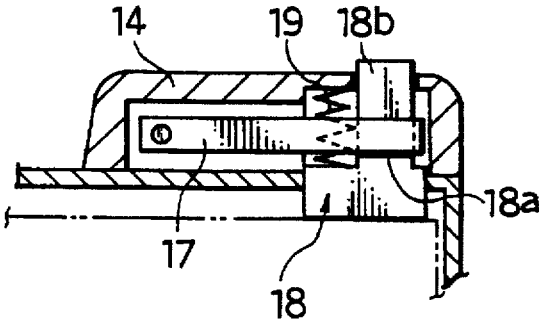
FIG. 4 is a longitudinal section of a push button-like locking means, which is used in the lock container.
Figure 5:
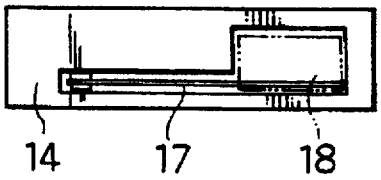
FIG. 5 is a top view of the push button-like locking means.

Referring to FIGS. 1 and 2, a lock container 10 for containing compact disks and the like according to the present invention comprises a casing 13 having an opening 12 on its rear side to permit a compact disk case 11 to get in or out, and a push button-like locking means 14 provided to the top side of the casing 13 to prevent the compact disk case 11 from getting out of the opening 12. The lock container 10 is made of a synthetic resin, which has a good stiffness. The lock container 10 has a window 15 large enough to permit customers to realize what compact disk is contained, although the lock container 10 is transparent or semitransparent enough to give a visible sight of the CD jacket contained therein.

The casing 13 has upper and lower catch pieces **16*a* and 16*b* integrally connected to the corners of the rear open side, thus preventing the CD case 11 from being taken out directly. When the CD case 11 is taken out from the casing 13, the CD case 11 is shifted to the upper extreme, thus leaving the lateral space on the bottom side. Then, the bottom side of the CD case 11 is released from the lower catch pieces 16*b*, 16*b*, and therefore, it can be raised. The bottom side of the CD case 11 is raised and pulled down to ride over the lower catch pieces 16*b*, 16*b*, thus causing the CD case 11 to leave the upper catch pieces 16*a*, 16*a***.

The push button-like locking means 14 is provided to the top side of the casing 13. It comprises a lateral spring strip 17 of a magnetic material, a push piece 18 partly projecting from the top side of the casing 13 in unlatching position. The push piece 18 has step-like projection **18*a* to be caught by the lateral spring piece 17 when the push piece 18 is depressed to be put in latching position, in which the CD case is fastened with the latch in the casing 13. A spring 19 is fixed to the push piece 18 to cause the push piece 18 to return to the unlatching position in response to application of magnetic attraction to the lateral spring strip 17, thereby releasing the push piece 18 from the lateral spring strip 17**.

The manner in which the lock container is used is described below. First, a CD case 11 is put in the opening 12, and the push button-like projection **18*b* of the locking means 14 is depressed, thereby pushing the CD case 11 against the bottom side of the casing 13 to leave a lateral space "A" behind between the top side of the casing 13 and the CD case 11. In this locking position, there is no room for the CD case 11 to move in the casing, thereby preventing the removal of the CD case 11 from the casing 13**.

When the push button **18*b* is depressed against the resilient force of the spring 19, the step-like projection 18*a* is caught by the lateral spring strip 17, thus holding the locking means 14** in this descending, locking position.

Figure 6:
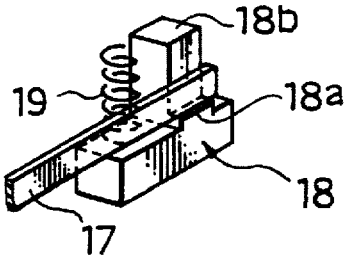
FIG. 6 is a perspective view of the push button-like locking means.

In this locking position the locking means 18 extends longitudinally to the full width of the top, lateral space "A", preventing the returning of the push piece 18 to the initial unlatching position; the step-like projection **18*a* is caught by the lateral spring strip 17, as seen from FIG. 6**.

In unlatching, a magnet is applied to the side of the casing 11 which the lateral spring strip 17 confronts, thereby applying a magnetic attraction force to the lateral spring strip 17 to release the step-like projection **18*a* therefrom. Thus, the push piece 18 is allowed to rise under the resilient influence of the spring 18, so that CD case 11 may use the lateral space "A" for movement and removal from the opening 12**.

The push button-like locking means 14 is described as being permitted to return to the initial, unlatching position by the effect of the spring member 18. The spring member 18 may be omitted, and then, the push button-like locking means 14 may be designed so as to be brought to the initial, unlatching position by displacing the CD case 11 in the opening 12 for removal.

As may be understood from the above, the CD case can be put in the opening space from the rear side of the lock container by putting the top side of the CD case under the upper catch pieces of the casing, and then by putting the bottom side of the CD case under the lower catch pieces of the casing, and then the CD case can be fastened with the latch in the casing. The putting-in of the CD case and locking of the container is quite easy.

The container can be unlatched simply by applying a magnet to the side of the casing which the lateral spring strip confronts to release the step-like projection of the push button-like latching means therefrom. The unlatching is quite easy, and is guaranteed to be free of any troubles which otherwise, would be caused for instance, by a deformed or worn key. Also, advantageously the strength of magnet which is adequate to release the step-like projection of the push button-like latching means from the lateral spring strip cannot be determined outside, and accordingly the safety against crime can be assured.

I claim:

1. A lock container suitable for accommodating a compact disk case therein, comprising a casing defining an opening configured to allow for insertion into and removal of the compact disk case from said casing, a means for catching at least lower corners of the compact disk case inserted into said casing, and a locking means which comprises a push piece with a step portion and a lateral spring strip made of a material sensitive to a magnetic force, the spring strip engaging with the step portion with one end thereof to urge the compact disk case against a bottom portion of the push piece to cause settlement of the compact disk case in said casing by cooperating with said catching means, when the push piece is pressed downwardly, and the spring strip disengaging from the step portion as to allow removal of compact disk from said casing through the opening, when a magnetic force is applied to the spring strip from outside of said casing.

2. The lock container according to claim 1, wherein said push piece is upwardly biased by a tension spring.

3. The lock container according to claim 1, wherein said catching means are catch pieces integrally formed with said casing.

4. The lock container according to claim 3, wherein said catch pieces are located on each corner of said casing.

5. A lock container suitable for containing a compact disk case therein, comprising:

(a) a casing defining an opening configured to allow for insertion into and removal of the compact disk case from said casing;

(b) catching means, located within said casing, for catching at least lower corners of an inserted compact disk case within said casing; and (c) locking means for selectively locking the inserted compact disk case within said casing, said locking means comprising (1) a push piece having a step portion and (2) a lateral spring strip made of a material sensitive to a magnetic force, wherein said push piece, said spring strip and said catching means are configured such that when said push piece is urged downwardly, one end of said spring strip is engaged with said step portion to urge the inserted compact disk case against a bottom portion of said push piece and to catch the inserted compact disk case in said catching means, thereby locking the inserted compact disk case within said casing, and wherein when a magnetic force is applied to said spring strip from outside of said casing, said one end of said spring strip is disengaged from said step portion, to allow for removal of the inserted compact disk case from said casing through the opening.

* * * * *